United States Patent [19]

Kukucka et al.

[11] 4,411,515

[45] Oct. 25, 1983

[54] VERY HIGH SPEED DUPLICATOR WITH LIMITLESS FINISHING FUNCTION

[75] Inventors: William P. Kukucka, Webster; Frank R. Hynes; Hugh L. Jones, both of Rochester; David M. Thompson, Fairport, all of N.Y.

[73] Assignee: Xerox Corporation, Stamford, Conn.

[21] Appl. No.: 373,779

[22] Filed: Apr. 30, 1982

Related U.S. Application Data

[63] Continuation of Ser. No. 180,073, Aug. 21, 1980, Pat. No. 4,358,197.

[51] Int. Cl.[3] ..... G03G 15/00

[52] U.S. Cl. ..... 355/14 SH; 270/58; 355/3 SH; 355/14 R

[58] Field of Search ..... 355/14 R, 14 SH, 14 C, 355/14 CU, 3 SH; 270/58

[56] References Cited

U.S. PATENT DOCUMENTS

| | | | |
|---|---|---|---|
| 3,830,590 | 8/1974 | Harris et al. | 270/58 X |
| 3,944,794 | 3/1976 | Reehil et al. | 235/92 SB |
| 4,134,672 | 1/1979 | Burlew et al. | 355/14 SH |
| 4,145,037 | 3/1979 | Mol | 270/58 |
| 4,146,216 | 3/1979 | Brown | 270/58 |
| 4,208,122 | 6/1980 | Iwamoto et al. | 355/14 R |
| 4,248,525 | 2/1981 | Sterrett | 270/58 X |

*Primary Examiner*—R. L. Moses

*Attorney, Agent, or Firm*—Bernard A. Chiama

[57] ABSTRACT

A copy set collecting and storage arrangement is disclosed for a high speed copy reproduction system or duplicator machine having a finishing station. The arrangement includes an elevator for collecting finished copy sets in a stack and a conveyor for receiving one or more stacks from the elevator. Controls are devised for "limitless" finishing wherein the duplicator is placed in Standby, count holding condition when the full storage capacity has been reached and the programmed reproduction run has not been achieved. The controls will effect automatic start-up again when one or more of the stacks have been removed until once again the capacity has been reached and the reproduction run has not been completed.

4 Claims, 18 Drawing Figures

11
12
13
14
15
18
20
21
22
24
25
26
27
28
29
30
31
32
33
34
35
36
37
38
39
40
41
50
51
52
54
55
56
57
58
59
60
61
65
66
P
D
102
112
92
93
94
95
100
132
134
136
154
162
165
166
167
168
130
138
SR-1
SR-2
SR-3
SR-4
SR-5
SOL-4
M-5
M-6
S-1

C
134
164
SOL-4
161
SET
155
159
SOL-2
160
162
163
158
156
157
M-4

0
100
200
300
400
500
600
700
800
900
1000
1100
1200
1300
1400
SHEET AT BIN ENTRANCE 93
SHEET #1
SHEET #2
SHEET #3
SORTER INDEX MOTOR M-1
ON
OFF
ON
OFF
ON
SET TRANSPORT MOTOR M-3
FWD ON
OFF
REV.
OFF
RETRACT
OFF
SET TRANSPORT CLAMP SOLENOID VALVE 147
CLAMP
STAPLER CLAMP CLUTCH SOL-3
STAPLER DRIVE CLUTCH (SOL-2)
CLINCHER SOL-4
KICKER CLUTCH 136

VERY HIGH SPEED DUPLICATOR WITH LIMITLESS FINISHING FUNCTION

This is a continuation of application Ser. No. 180,073, filed Aug. 21, 1980, now U.S. Pat. No. 4,358,197.

This invention relates to an improved reproduction system having an improved finishing station for use in such system.

With the advent of higher speed and more sophisticated copy producing machines, printing presses, and the like, considerations as to how the mass of copies generated can best and most effectively be handled has assumed increasing importance. One way has been to provide a reproduction system with an input device in the form of a recirculating document handling apparatus. In this system, a document sheet is removed from a collated set of document sheets, placed on an exposure platen for exposure at the rate of one exposure for each document sheet, and returned to the top of the set in the document handling apparatus until the set of document sheets has been completely circulated through the apparatus, and a copy set has been produced. The set of document sheets is then recycled for the reproduction of a second copy set, and so on. After each copy set is produced and collected at a collection station, a finishing device such as a stitcher or stapler is activated to bind the set. These systems are of the pre-collation type wherein the document sheets are pre-collated in the document handling apparatus prior to commencement of a reproduction run. The output for the reproduction machine will likewise be pre-collated in sets corresponding to the sequenced numbered document set in the document handling apparatus. The copy sheets are collected in collated sets as they are sequentially produced so that binding may be effected without the interaction of additional devices. Such systems are described in the U.S. Pat. No. 4,134,672.

The disadvantage in these systems having continuous document recirculation to produce each bound copy set is that the speed of production is limited to the mechanical limitations in the speed of handling document sheets in the document handling device. It necessitates that the input device, the document handler, be of extreme high reliability as it places the original document sheets under the severe stress of being constantly recirculated. In practice, for these systems, there appears to be a threshold in the production rate of finished copy sets. The failure rate in the document handling apparatus increases beyond acceptable limits when too high a speed of sheet movement in the apparatus is attempted.

To achieve high rates of production of finished copy sets, it is preferred that the present invention be incorporated in reproduction systems utilizing post-collation, although, pre-collation is also contemplated. The inventive arrangement disclosed herein involves the use of an elevator mechanism, a conveyor mechanism, and a control system for collecting copy sets or stacks in two or more piles thereby maintaining the higher throughput for a very fast reproduction machine. By collecting in two or more piles, the opertor has additional lead time in which to interface with the machine in removing finished copy sets or stacks.

The collecting of copy sheets is accomplished in either of two modes of operation: the sets mode wherein copy sheets are collected in accordance with the sequence of document sheets so as to produce collated copy sets; or the stack mode wherein copy sheets are collected so that each collected stack contains copies of only a single document sheet.

The elevator mechanism includes an elevator upon which finished copy sets or stacks are deposited and means for lowering the elevator as the sets or stacks are collected. The elevator mechanism also includes conveyor belts which are set in motion when the elevator reaches a lower predetermined position and conveys a collected pile of sets or stacks to the conveyor mechanisms if the latter does not already have a pile thereon. If no pile is present on the conveyor mechanism, the conveying belts of the elevator mechanism will convey the pile upon the conveyor mechanism, the elevator will move upwardly to its uppermost position and start collecting additional copy sets or stacks until another full pile has been accumulated. When the elevator again reaches its lowermost position, and with a pile still on the conveyor mechanism, the reproduction system will revert to a "standby" condition, if a programmed reproduction run has not been completed. When the operator removes one or both of the piles, the run will automatically commence until once again two piles are present, or the run completed.

The conveyor mechanism is utilized to carry finished copy sets or stacks out of the interior of the machine for easy removal. The mechanism can be devised to carry more than one pile since one of the actuators for controlling its operation and whether the reproduction system goes into standby condition is located at the remote end of the conveyance on the conveyor mechanism.

Therefore, in the present invention, advantage is taken of post-collation by utilizing an output device, such as sorter bins in combination with a finishing device. Present day machines on the market, such as the Xerox duplication machine labeled the 9200 ® Duplicator marketed by Xerox Corporation of Stamford, Conn., utilizes a document handler as an input device which exposes as many copies of a single document sheet at a time as is appropriate before starting on the next document sheet. However, in order to achieve binding, with these machines, the collected collated sheets must be manually removed from the array and transported to a finishing device whereat stitching or stapling is provided. This arrangement for producing finished copy sets seriously limits the throughput for the entire system.

It is therefore the principal object of the present invention to produce bound sets or stacks of copies of a multi-page document at the highest speed possible for a reproduction machine.

It is a further object of the present invention to maintain high productivity in a reproduction/finishing system by controlling the movement of finished copy sets or stacks out of the system.

It is another object of the present invention to control movement of finished copy sets or stacks in a finishing station whereby the host reproduction machine will revert to a standby condition and hold its programmed count in the event accumultion of collected copy sets or stacks has reached the capacity of receiving mechanisms.

It is another object of the invention to unload automatically copy sets or stacks collected at a collection station and to arrange then in offset manner upon operator unloading facilities.

Other objects and advantages will be apparent from the ensuing description and drawings in which.

Figure 1:
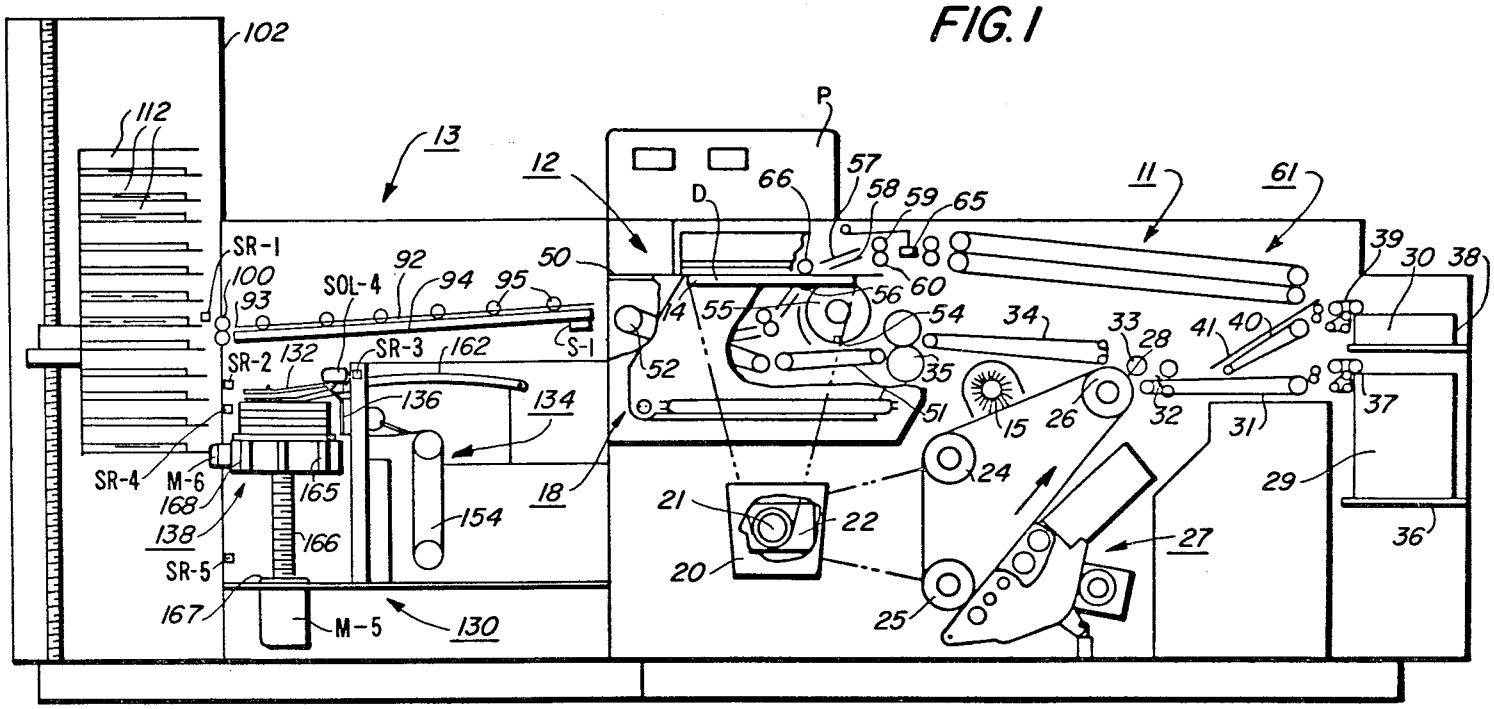
FIG. 1 is a schematic illustration of a configuration of an electrostatographic printing/finishing system employing the present invention.
Figure 11:
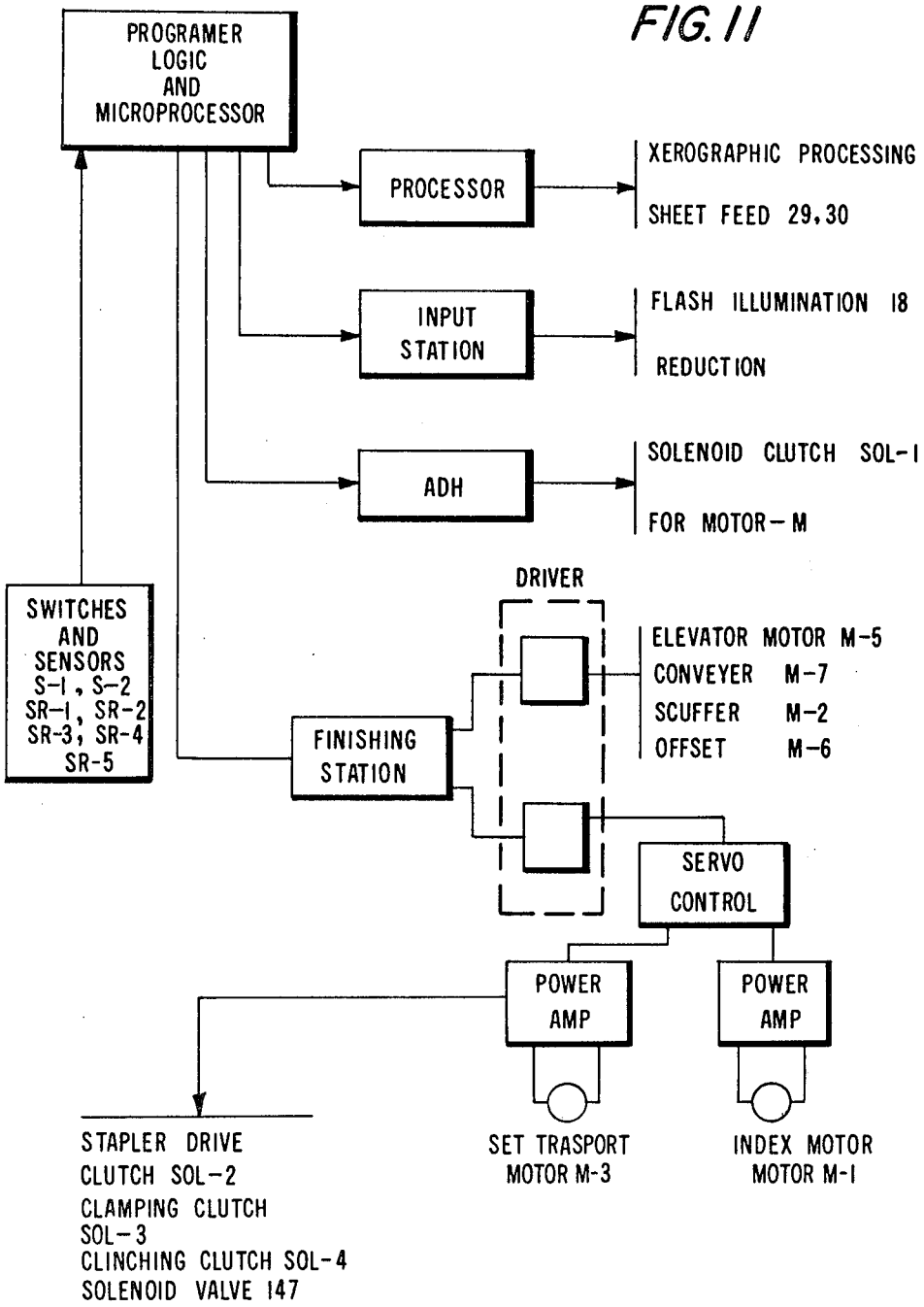
Figure 12:
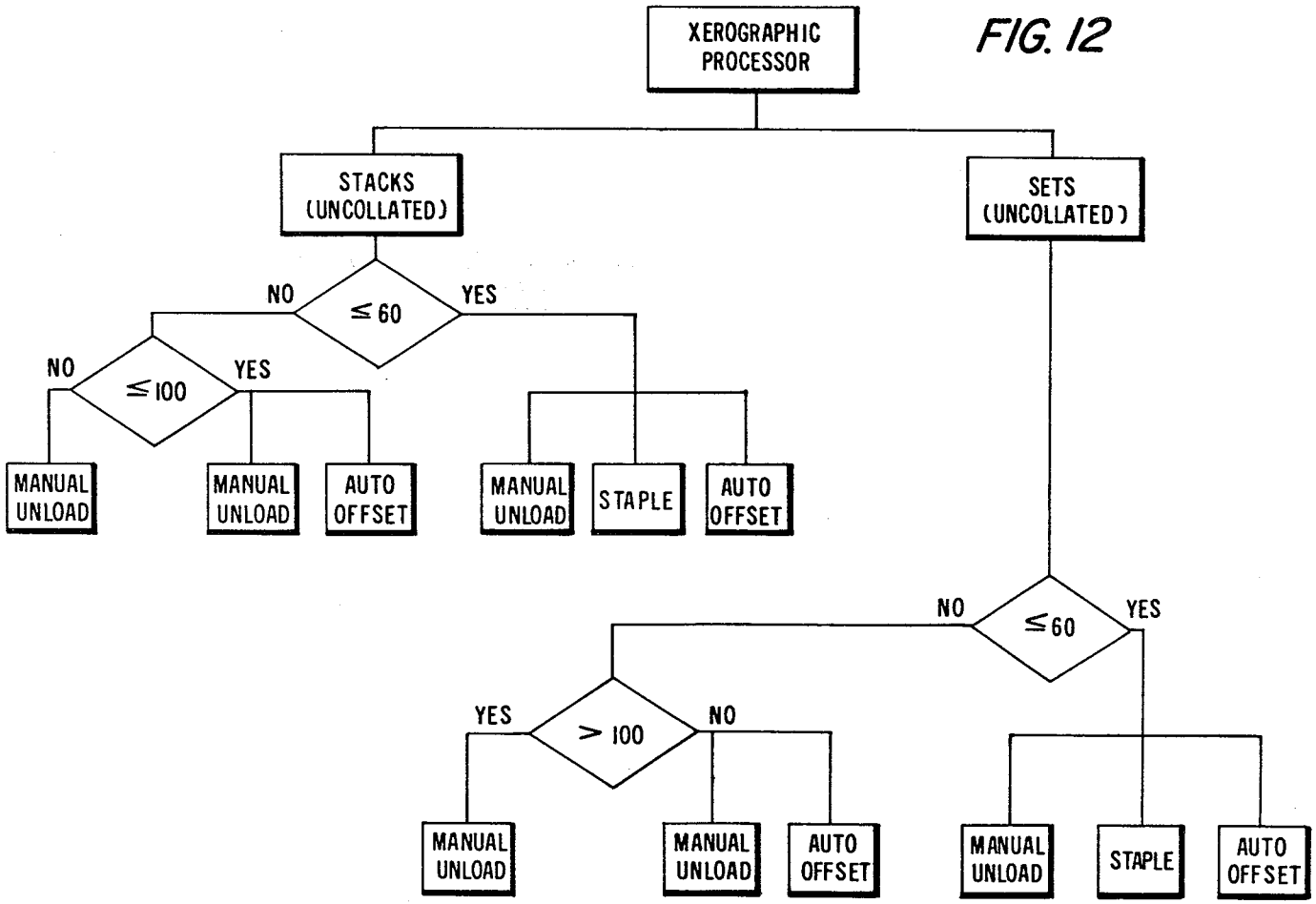

FIGS. 9(*a*) to 9(*d*) illustrate a sequence of events in the finishing of sets of copy sheets having an odd number of sheets;

FIGS. 10(*a*) to 10(*d*) illustrate a sequence of events in the finishing of sets of copy sheets having an even number of sheets;

FIG. 11 is a block diagram of the control scheme for the printing system of FIG. 1, and FIG. 12 is a flow diagram of an algorithm for producing various functions in the system.

For a general understanding of a reproduction machine with which the present invention may be incorporated, reference is made to FIG. 1 wherein components of a typical electrostatic printing system are illustrated. The printing system is preferably of the xerographic type as one including a xerographic processor 11, and a document handling apparatus 12. Preferably, the processor 11 is the same as the processor in the commerical embodiment of the Xerox duplicators, models 9200® and 9400®, which utilizes flash, full frame exposure, for very high speed production. Similarly, the document handling apparatus 12, is the same as those used in the same machines. It will be understood that most any other type of xerographic processor and multiple exposure document handling apparatus may be utilized. Operating in conjunction with the processor 11 and apparatus 12 is a finishing station 13 and thereby forms the reproduction system shown in FIG. 1.

As in all xerographic systems, a light image of an original to be reproduced is projected onto the sensitized surface of a xerographic photosensitive surface to form an electrostatic latent image thereon. Thereafter, the latent image is developed with toner material to form a xerographic powder image corresponding to the latent image on the photosensitive surface. The powder image is then electrostatically transferred to a record material such as a sheet of paper or the like to which it may be fused by a fusing device whereby the powder image is caused to adhere permanently to the surface of the record material.

The xerographic processor 11 is arranged as a self-contained unit having all of its processing stations located in a unitary enclosure or cabinet. The processor includes an exposure station at which an original to be reproduced is positioned on a glass exposure platen 14 for projection onto a photosensitive surface in the form of a xerographic belt 15. The original or set of individual document sheets are selectively transported by the document feed apparatus 12 one document sheet at a time to the platen 14 for exposure. After a predetermined number of exposures of each document sheet is made, the same is returned to the top of the set until the entire set has been copied. A suitable document handling apparatus of this type is described in U.S. Pat. No. 3,944,794, commonly assigned, which is hereby incorporated by reference.

Imaging light rays from each of the document sheets, which is flash illuminated by an illumination system 18 having suitable lamps 19, are projected onto the xerographic belt 15. The lamps 19 are connected to a suitable flashing circuit (not shown) which is controlled by the programmer for the processor in timed sequence, and in accordance with the program the operator has preset in the machine. Further details in this regard are not necessary since the Xerox 9400® reproduction machine operates in this manner and is well known. The xerographic belt 15 is mounted for movement around three parallel arranged rollers 24, 25, 26 suitably mounted in the processor 11. The belt is continuously driven by a suitable motor (not shown) and at an appropriate speed. The exposure of the belt to the imaging light rays from a document discharges the photoconductive layer in the area struck by light whereby there remains on the belt an electrostatic latent image corresponding to the light image projected from the document. As the belt continues its movement, the electrostatic latent image passes a developing station at which there is positioned a developer apparatus 27 for developing the electrostatic latent image.

After development, the powdered image is moved to an image transfer station 28 where the developed image is transferred to a support surface, normally a sheet of copy paper, brought from a main or auxiliary paper tray 29, 30, respectively, as will appear.

Figure 2:
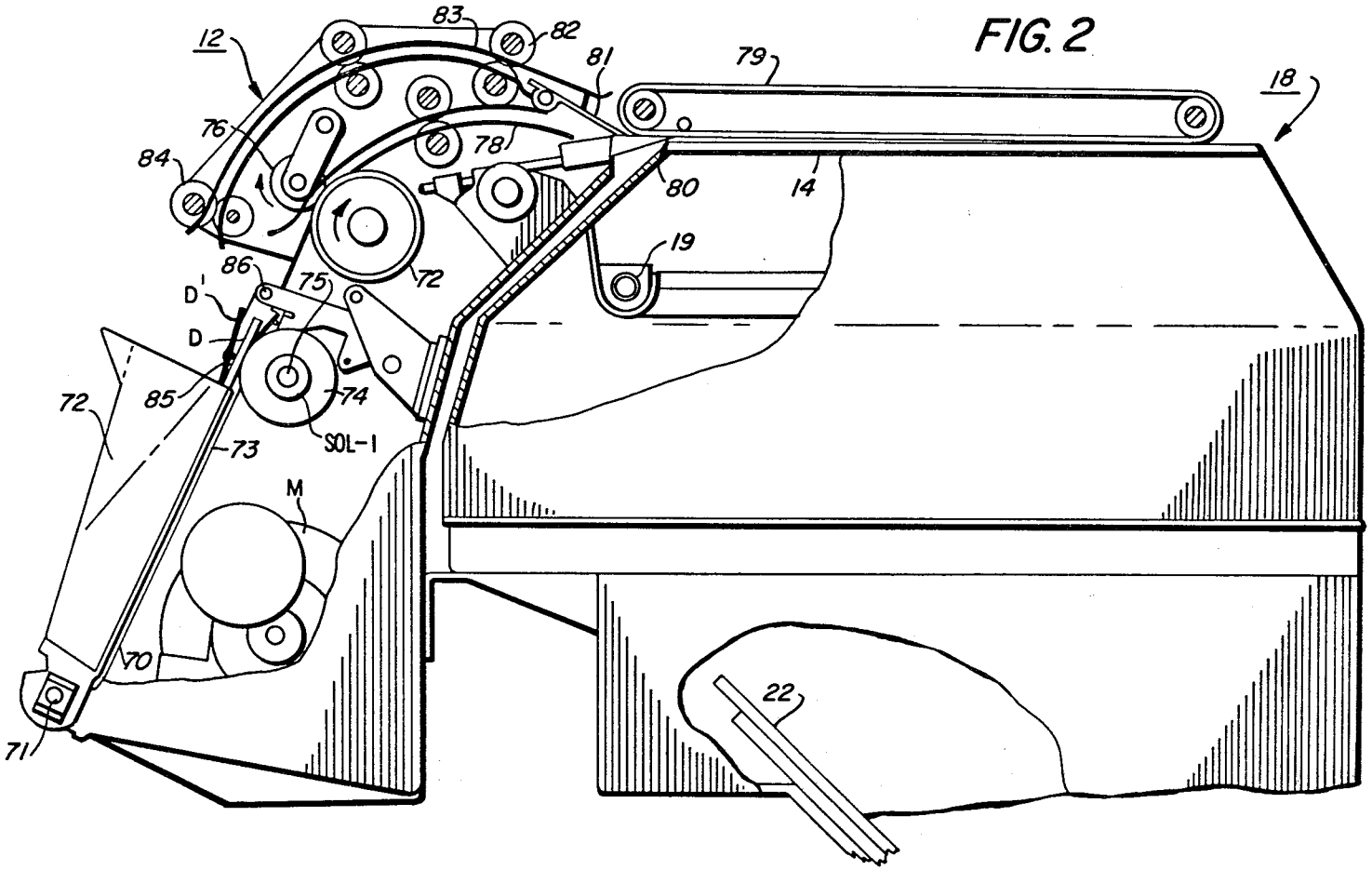
FIG. 2 is an elevational view of the document handling apparatus utilized in the printing system of FIG. 1.

Each sheet is conveyed to the transfer station by a conveyor 31 which cooperates with sheet registration fingers 32 (only one shown). These fingers rotate in a counterclockwise direction, as shown in FIG. 2, and engage the leading edge of a sheet, being adapted to effect the accurate timing and positioning of a sheet relative to the movement of a developed image on the belt 15 and the other timed events in reproduction processing. Further details of the timing reltionships and related structure and events are described in U.S. Pat. Nos. 3,790,270; 3,796,486; and 3,917,396, commonly assigned, and which are incorporated herein by reference.

The sheet is moved in syncrhonism with the movement of the belt 15, and passes between a transfer roller 33 and the belt 15 at the transfer station. After transfer, the sheet of paper is stripped off the belt 15 and transported by a vacuum conveyor 34 in an inverted condition to a fusing station where a fuser device 35 is positioned to receive the sheet of paper for fusing the powder thereon. After fusing, the sheet is eventually transported to a finisher station to be described hereinafter either to be stapled in copy sets or merely to be separated into sets without binding.

The system comprising the processor 11 and the document handling apparatus 12 is under control of a programmer P which permits an operator various options: to turn the entire system ON or OFF; to program the reproduction system for a desired number of reproductions to be made of each original document sheet or set; to select whether simplex or duplex copies are to be made; to select a desired output arrangement, that is, sets mode or stacks mode, stapled or unstapled; to select one of a plurality of paper trays; to condition the machine for the type of document, that is, whether one sided or two sided, to select a copy size reduction mode, and other desirable functions. The programmer P also includes a controller which provides all operational timing and synchronization between the processor 11 and all of its xerographic processing functions, and system control functions, the automatic events to be described hereinafter. The controller may include any suitable microprocessor having a CPU and the appropriate machine clock, but preferably the processor is one similar to the Intel 8080 microprocessor manufactured by the Intel Corporation, Santa Clara, Calf., and having sufficient ROM's and RAM's for all of the necessary functions in the reproduction system.

As previously stated, copy sheets are supplied from either the main paper tray 29 or the auxiliary paper tray 30. Main paper tray 29 includes a suitable elevator type base 36 on which a supply of sheets rest, base 36 being supported for automatic up and down movement by suitable means (not shown) designated to maintain paper feed belt 37 in operative contact with the topmost one of the sheets on the elevator 36. The belt 37 is operated intermittently in timed relationship to spacing of images on the photoreceptor belt 15 and serves to advance the topmost sheet from the supply stack 29 to the main paper supply transport 31.

The auxiliary tray 30, in the exemplary arrangement shown, is arranged above main tray 29 and includes a suitable elevator type base 38 on which a supply of sheets may be provided. As with the main supply tray 29 suitable means (not shown) are provided to raise base 38 of auxiliary tray 30 as the supply of sheets thereon are used up so as to maintain the paper feed belt 39 in operative contact with the topmost sheet. The paper feed belt 39, which is intermittently driven in the same manner as main tray feed belt 37, advances one sheet at a time to an auxiliary paper supply transport 40. The transport 40 is suitably driven by a drive system not shown and is disposed to discharge sheets drawn from auxiliary tray 30 onto the operating run of main supply transport 31. The sheets from auxiliary tray 30 are thereafter fed to the transfer station. Guides 41 serve to maintain the sheets in driving contact with the auxiliary paper supply transport 40 during movement therealong.

During use, copy sheets leaving the processor 11 after exiting the fuser appratus 35 are conveyed to an exit slot 50 by way of transports 51, 52, if the reproduction system is set for the simplex or one sided copying. If the system has been programmed for duplex or two sided copying, copy sheets will be directed to the auxiliary tray 30. If the latter mode of operation is selected, copy sheets conveyed by the transport 51 are intercepted by a deflector 54 which is adapted for movement into the sheet path. When the deflector 54 is in the interrupt function, the copy sheets are carried around a roller 55 and through the nip formed by this roller and a cooperating roller 56. The sheet is advanced by rollers 55, 56 between an upper sheet guide baffle 57 and a lower sheet guide baffle 58 to a second roller pair 59, 60 which further advances the sheet to a transport mechanism 61 which carried the sheet to the auxiliary paper tray 30. When the desired number of one sided copies have been produced and delivered to the tray 30, the paper handling mechanism for the main tray 29 may be inactivated and the paper handling mechanism for the auxilliary tray 30 activated. It should be understood that in following the paper path around roller 55 and between roller 59, 60, the copy sheets are turned over, i.e., the printed material is on the top of the sheets in the tray 30.

Upon reenergization of the system, the sheets from the tray 30 are fed through the reproduction machine by means of the feed belt 39 and the transport 40 for copying on the blank side of the sheet in the same manner as described heretofore. With the reproduction system being programmed for the duplex mode, and after completion of the correspondingly programmed number of one sided sheets, reenergization of the system also produces the raising of a sheet stop 65 into the paper path between the upper guide baffle 57 and the lower guide baffle 58. The feed roller 59 is mounted on the upper baffle 57 to be raised therewith during the phase of duplex copying. In this manner, the feed roller 59 will be displaced away from lower feed roller 60 so that papers fed therebetween are not forwarded thereby.

The sheet stop 65 is formed of a ring-shaped resilient material being compliant enough to resume its circular shape and thereby effecting the insertion of a sheet into the nip formed between roll 56 and a cooperating roll 65, the trailing edge of the sheet being carried by roll 56 into the nip. The rolls 56 and 66 are formed of a high friction material such as polyurethane foam to assure positive feeding of a sheet travelling toward stop 65 and positive feeding of the sheet travelling away from stop against the drag force generated between two sheets which may be in the inverter area at the same time travelling in opposite directions. The purpose of the stop 65 and the cooperating action of the rollers 56, 66 is to invert each copy sheet, while production is in the duplex mode, so that the odd numbered page on a copy sheet reaching the exit slot 50 is on the bottom of the sheet.

As shown in FIG. 2, the document handling apparatus 12 serves to feed one document sheet at a time from a supply of document sheets D into copying position on the platen 14 where a single exposure if only one copy set is programmed, or a plurality of exposures may be made. Following exposure one or more times, each document sheet is automatically returned to the document supply and the next document sheet, if any, is brought into the exposure position on plate 14. As will appear, document sheets returned to the supply stack may be recycled by the apparatus 12 or simply removed by the user when the copying program is completed.

The document handling apparatus 12 includes base section 70, the lower end of which swingably supports by means of a shaft 71, matching left and right hand tray members 72. The trays 72 are substantially U-shaped when seen in cross section, each having a base 73, which are shown cut away at the upper ends thereof to accommodate a document separator/feed roll 74. The trays are adjustable along shaft 71 to accommodate various size documents.

The document separator roller 74 is rotatably supported on a drive shaft 75 under the base section 70 such that a portion of the periphery of the roller projects into the document tray area, the base 70 being suitably apertured to accommodate the separator roller. The shaft 75 is supported for rotation and driven by a continuously driven motor M through suitable pulleys and belts (not shown) in the direction shown by the solid line arrow of FIG. 3. A solenoid clutch SOL-1 drivingly connects the motor M to the separator 74 in response to a signal from the machine logic in timed sequence in accordance with the programming arrangement in the logic.

A pair of document limiting rollers 76, 77 are disposed on the downstream side of separator roller 74 and function to prevent passage of more than one document sheet at a time. The upper limiting roller 76 is arranged to be driven by the lower limiting roller 77 so long as friction developed between rollers 76, 77 remains above a predetermined setting. In the event of a decrease in roller friction, as occasioned by an attempt of two superimposed document sheets to pass theretrough, the upper roller 76 is turned in a document rejecting direction as shown by the dotted line arrow in FIG. 3 by a suitable drive means (not shown). Document sheets emerging from limiting rollers 76, 77, are carried forward by intermediate rollers underneath a curved document guide 78 to a platen transport belt conveyor 79 which in turn carries the document onto the platen 14.

A register edge 80 is provided across the inlet side to platen 14, and serves to register or locate document sheets in pre-set position on platen 14 for exposure thereof. The movement of the platen transport belt 79 is reversed for this purpose after the document sheet has been carried past the register 80, reversal of transport 79 serving to move the document sheet backwards to bring the document sheet trailing edge into abutment with register edge 80. When exposure is completed, the platen transport belt 79 is again operated in reverse to move the document sheet backwards off the platen 14, the register edge 80 being retracted for this purpose by a suitable means (not shown). The document guide fingers 81 deflect or guide the returning document upwardly into the nip of a first return transport roller pair 82, which carry the returning document sheet between return guides 83 and into the nip of a second return transport roller pair 84 and back into tray members 72.

To maintain the returned document sheets which have been designated for convenience by the letter D', segregated from document sheets D awaiting feeding and prevent inadvertent refeeding of returning document sheets D' by the primary feed roller 74 following feed of the last one of the original document sheets, a displaceable bail or separator bar 85 is provided substantially opposite to and above the feed roller 74. The bar 85 is supported from a rockable cross shaft 86 which is suitably journaled in the supporting framework of document apparatus 12 with the base section 70 thereof being suitably apertured to permit disposition of the bail support arms 87 therethrough. Means (not shown) are provided to selectively turn the shaft 86 and raise the bar 85 out from under the document sheets D' resting thereupon and thereafter return the bar 85 back onto the topmost one of the document sheets in the supply. All of the rollers heretofore described are driven by the motor M by way of suitable pulleys and belts (not shown). Since the particular document apparatus 12 is a commercial device being a part of Xerox Corporation's product, labelled the 9200® Duplicator, and is adequately described in U.S. Pat. No. 3,944,794, further description thereof will not be included herein.

Further details of the processing devices and stations in the printer system or processor are not necessary to understand the principles of the present invention. However, a detailed description of these processing stations and components along with the other structures of the machine printer are disclosed in U.S. Pat. No. 4,054,380 which is commonly assigned with the present invention and which is incorporated by reference herein.

As previously described, the document apparatus 12 includes a document tray adapted for supporting a stack comprising a plurality of document sheets in numbered sequence with page one of the multi-page document on the bottom of the stack. Since the illustrated document handling apparatus is of the bottom feeder type, page one will be the first document sheet imaged, and so on.

For either the simplex or duplex modes of operation, copy sheets exiting the fuser device 35 are directly conveyed by the transports 51, 52 to and through the exit slot 50 positioned at one end of the housing for the xerographic processor 11. As sheets exit the slot 50, they are directed to the finishing station 13 which comprises a sorting mechanism, a stapler apparatus, and an output elevator/conveyor system. After leaving the processor 11, as shown in FIG. 1, each sheet is positioned upon a transport 92 to be further conveyed generally along the same horizontal plane as its previous path to a fixed receiving point or station 93. The transport includes a movable endless transport belt 94 upon which each sheet is placed and a plurality of loosely retained rotatable balls 95 which rest along the belt 94 by gravity and which coact with the belt to convey sheets therebetween. The belt 94 is driven by a motor and suitable gearing and pulleys (not shown) at a speed slightly greater than the processing speed of the processor 11 in order to add more working space between the sheets and to ensure that the final handling of copy sheets does not impede the throughput of the entire system as determined by the process speed.

It will be noted that the axis of the belt 94 is at a slight angle to the direction of the movement of the copy sheets. This arrangement drives each sheet of copy slightly laterally against a side registration edge 97 which is parallel to and offset from the centerline of the incoming path of sheet movement. As viewed in FIG. 3, the sheet S as can be seen through a sheet clearance opening 98 formed in the top plate 99 of the transport 92. In this orientation, the sheets are positioned so that their toner image side is down, for the simplex mode, or an odd numbered page is down for the duplex copying mode, and the top of each sheet is along the edge 97.

At the exit solt 50, a sheet contacting switch S-1 is positioned to be actuated as each sheet enters the transport 92 of the finishing station 13. The circuit for this switch is connected to the logic in the programmer P and serves to re-set the machine clock for the finishing function so that zero time for the sheet commences when the sheet is at the reference point 93.

At the receiving station 93, there is positioned a pair of contacting transport rollers 100 which receive each copy sheet within the nip for directing a sheet into a bin of an array of collecting bins, or sorter generally indicated by the reference numeral 102. In the illustrated embodiment, the array 102 includes twelve horizontally disposed bins 104 arranged in a vertical column, the number of which corresponds to the predetermined number of exosures made of each document sheet while it is on the platen 14. The number of bins utilized should correspond to the total number of sheets in the paper path during the first pass duplex mode so that machine "pitches" are not skipped. The number of exposures made for each document sheet positioning on the platen also corresponds to this total number of sheets, which for the illustrated machine is twelve sheets.

Figure 3:
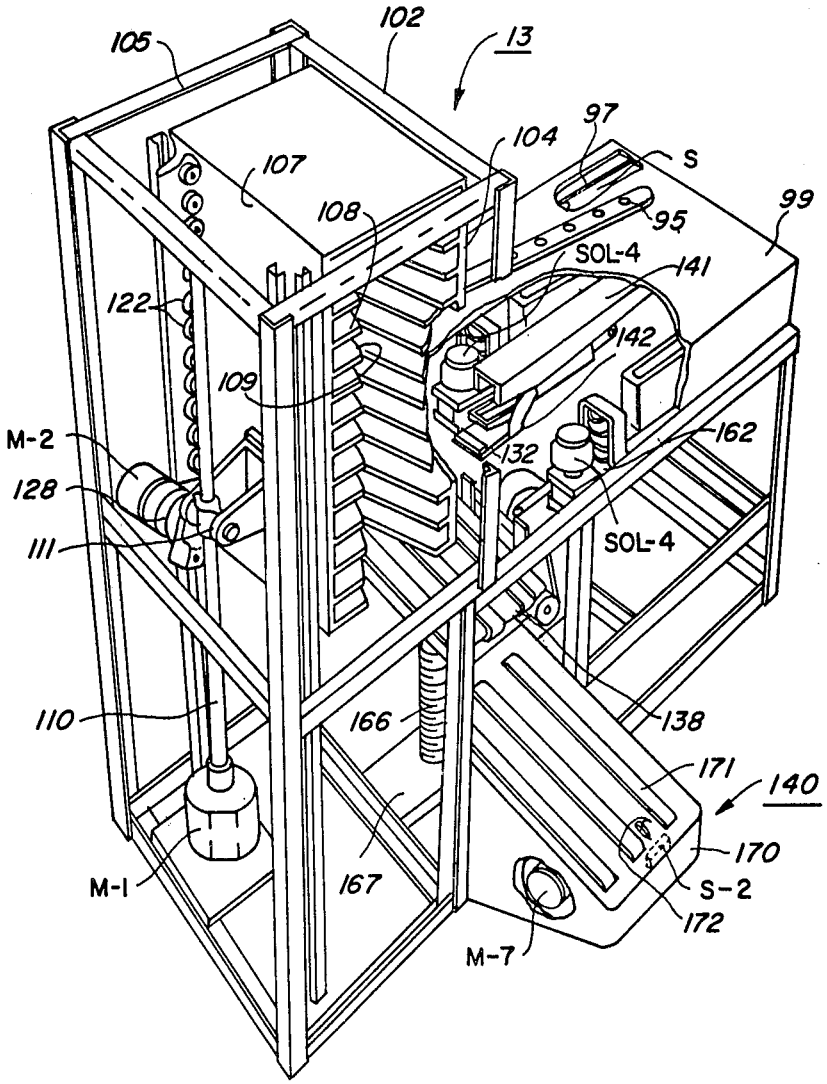
FIG. 3 is an isometric view of the finishing station utilized in the system of FIG. 1.

The array 102 is mounted for bi-directional vertical movement within a supporting fixed frame 105. As shown in FIG. 3, the array is positioned in its normal standby position with the lowermost bin opposte the nip of the rollers 100 at the fixed station 93.

For ease of understanding later description, the bins are numbered consecutively from 1 to 12 starting at the lowest bin with bin numbered 12 at the top of the array. The array is arranged to be indexed in both the up and down directions past the receiving point 93 which is the bin sheet receiving position. Upon operating in the sets mode, the array indexes downwardly one bin at a time and as each bin becomes aligned at the station 93, movement of a copy sheet through the transport 99 and the rollers 100 is timed to enter the bins. A suitable sensor SR-1 may be positioned at the front edge of the bin to indicate to the system logic that this action has occurred and to enable another indexing operation.

When the array reaches its lowermost position and bin numbered 12 has received a copy sheet, the document handling apparatus 12 has already removed from the platen the document sheet which initiated the production of the copy sheets and add a successive document sheet of a set. Actually, since there are a number of images being processed in the processor 11 and a few copy sheets in the paper path being conveyed by the various transports, document sheet changes would have occurred much eariler than the time that copy sheets indicative thereof are beginning to be received in the array 102. The array will remain in the lowermost position until the first copy sheet of the next succeeding document sheet has been received in the bin numbered 12 whereupon the array will index upwardly now to permit reception of the copy sheets as before. This up and down indexing action and sorting continues until each bin 104 carries a collated set of copy sheets for the set of document sheets in the document handling apparatus 12.

As will be described hereinafter, a set binding apparatus in the form of a dual stapler apparatus is arranged immediately below the bin receiving point 93. This apparatus includes means to remove completed sets of collated copy sheets from every other bin to effect single or dual stapling along an edge of the set if so programmed or no stapling at all, and to position the stapled or unstapled sets on an elevator mechanism. In order to permit complete removal of the sets from all of the bins 104 in the array 102, the array must move twice relative to the point of set unloading. In the normal operating sets mode, the sorter/finishing arrangement handles twelve sets at a time (a block of 12 copy sets) in cooperation with the document handling apparatus 12 as the latter exposes each document sheet twelve consecutive times before advancing to the next document sheet until the complete set thereof has been exposed. If more than twelve copy sets have been programmed, the document apparatus/sorter finisher system will complete the reproduction run in blocks of 12 copy sets. The system will continue to sort and automatically unload in blocks of 12 sets until the programmed number of sets is completed.

The bin array 102 includes a side wall 106 and a rear wall 107 to which the bins 104 are secured and which close off two adjacent sides of each bin. The front side of the bins, or that side facing the transport 92 is open to receive copy sheets, while the side which faces the operator is also open to permit removal or manipulation of sheets or sets. The bottom wall of each bin is formed with a cut-out 109 to assist in operator sheet removal.

The bin array 102 is driven vertically in either direction by a ball screw 110 connected to the shaft of a servo motor M-1 which is mounted to the base of the frame 105. These movements of the array are effected by a ball 111 secured to the rear wall 107 of the array and through which the screw 110 is threadedly related. Rotation of the screw (which is fixed against axial movement) in either direction will impart corresponding up or down movement of the ball 111, and consequently the array.

Figure 4:
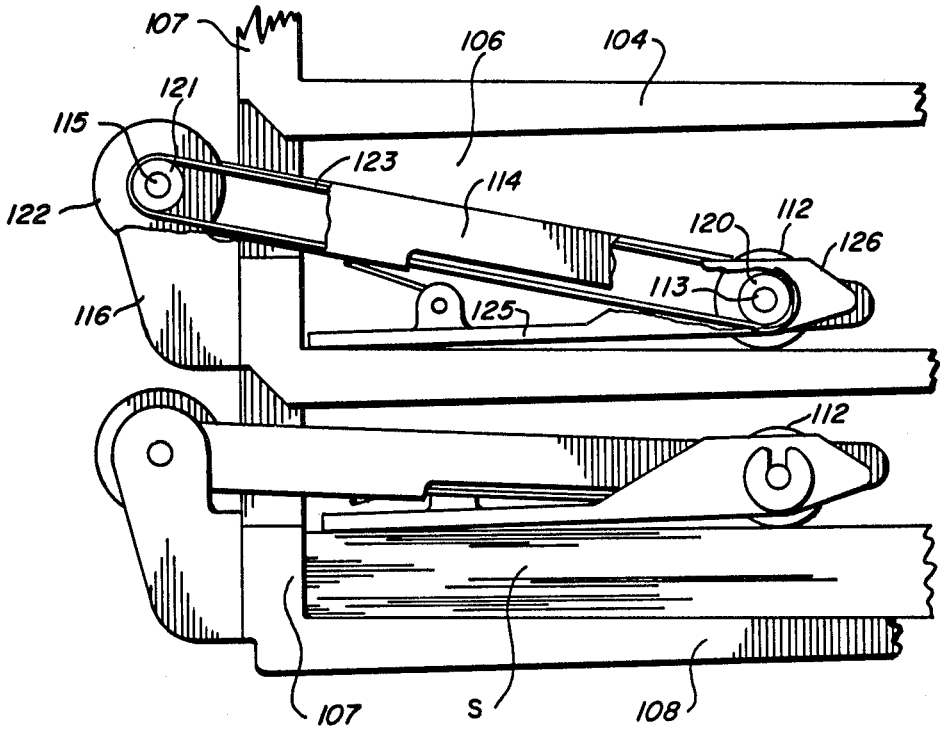
FIG. 4 is an elevational, fragmentary view of a collating bin collecting mechanism showing a detail thereof.

Each of the bins 104 is provided with a scuffer mechanism which is used to pull sheets into the bin and serves to register each sheet against both the interior sides of rear wall 107 and the left side 106 of the bin as sheets are sorted. Since all 12 of the scuffer assemblies are identical only one will be described in detail. As shown in FIG. 4, each scuffer assembly is positioned adjacent the corner defined by the rear and left side walls and includes a scuffer roller 112 which has its axis of rotation positioned at a slight angle relative to the rear wall so as to effect the two sided or corner registration. The scuffer is rotatably mounted on a pin 113 secured to and between one end of a pair of closely-spaced arms 114, the other ends of which are rotatably mounted on a pin 115 secured by a bracket 116 to the rear wall 107 of the array 102. With this arrangement, the scuffer wheel rests by gravity upon the bottom wall 108 of the bin and will rise slightly as each sheet is conveyed into the bin. When a pile of copy sheets S have been collected as shown in FIG. 4, the wheel 112 will have risen to approximately its highest position.

Each scuffer wheel 112 is provided with a pulley 120 concentric therewith and a similar pulley 121 is secred to a friction drive wheel 122. A timing belt 123 is applied to the pulleys 120, 121 for imparting rotary motion to the scuffer wheel 112 when rotation is applied to the drive wheel 122. A flat plate 125 is also pivotally mounted on the pin 113 by means of and as part of a bracket 126 and extends toward the interior side of the rear wall 107 as well as the interior side of the side wall 106. This plate assists in providing a normal force to the scuffer wheel and serves to prevent inadvertent curling of sheets and possible spindling as they move into a bin.

The scuffer drive wheels 122 are arranged vertically with their axes in a common plane so that each will be in a position to be contacted by a single drive wheel. As shown in FIG. 3 each of the drive wheels contacts a knurled drive wheel 128 when the respective bin is in the fill or sheet collecting position. The wheel 128 is driven by a motor M-2 secured on the frame 105 approximately at the midpoint of the total path of movement of the array. This positioning of the wheel 128 is such that driving contact can be made with each of the friction wheels 122 as the array moves to either of its upper or lower positions. With this arrangement, wherein a scuffer roller is being activated only when its respective bin is a fill position minimizes wear of the roller and to eliminate any possible copy quality problems. This arrangement is also much more economical and trouble-free than is the use of individual jogging mechanism while still providing more accurate set registration. The left side wall 106 against which each copy sheet is registered is very slightly offset but parallel to the registration edge 97 in the transport 92. During movement through the transport 92, each sheet experiences a course registration along the edge 97 and the corner, two sided registration provides the fine and accurate registration needed for high quality set binding. For very high speed reproduction and finishing coarse and fine, two stage registration is highly desirable for best sheet compiling.

After copy sheets, simplex or duplex, have been produced in the processor 11, transported by the transport 92 and collected in the bin array 102 while the system is in either the sets mode or the stacks mode, the collected sets are now in condition to be further processed by a finishing apparatus generally indicated by the reference number 130. Actually as will be discussed below, during the last series of indexing movement of the bin array when it is moving from its uppermost position to its lowermost position, if this direction is to be the last movement during collections, copy sheet removal for the finishing action may take place simultaneously with collection of copy sheets.

The finishing apparatus 130 comprises five subassemblies each of which is programmed to operate in timed sequence with each other, with the system logic and programmer P, to be timed relative to the number of sets and copy sheets per set which were previously pre-programmed, and with the document sheet actuation of the apparatus 12. As shown in FIGS. 1 and 3, the finishing apparatus comprises a set transport 132, individually-operable, dual stapler apparatus 134, and a set kicker 136. In conjunction with the finishing apparatus 130, the finishing station 13 also includes an elevator 138 and sets/stacks conveyor 140.

Figure 5:
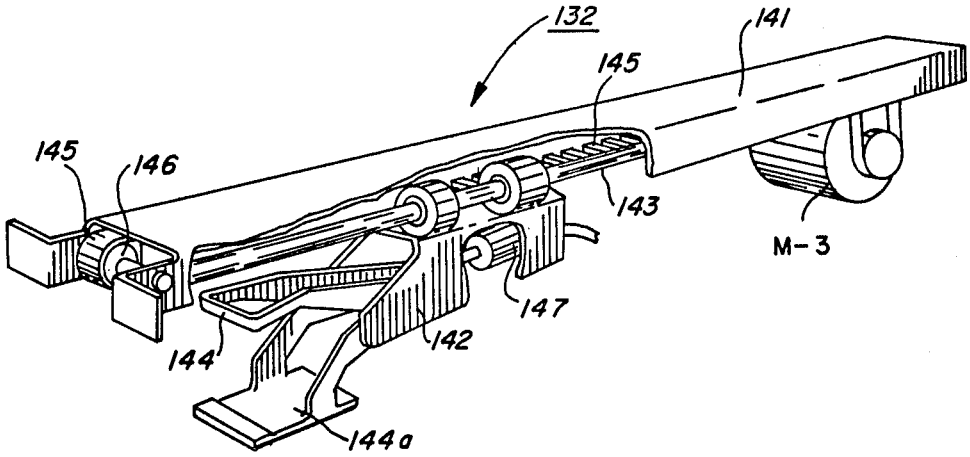
FIG. 5 is a partial isometric view of the set transport mechanism utilized in the finishing station.
Figure 6:
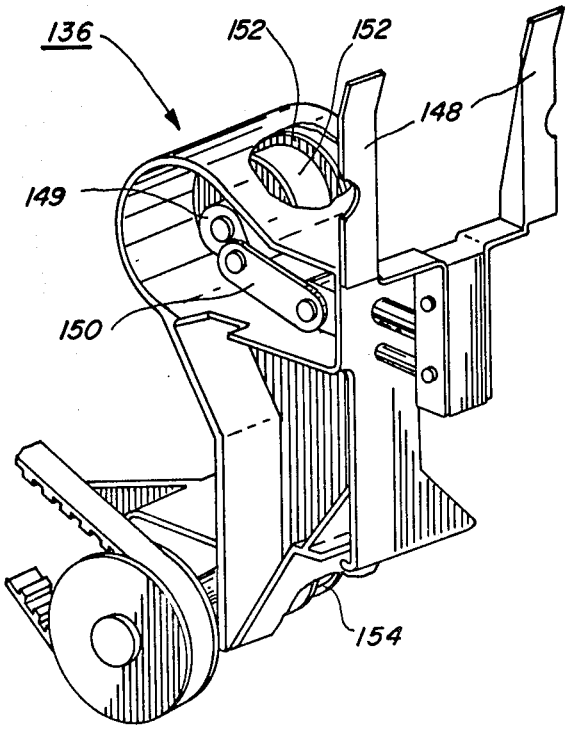
FIG. 6 is a partial isometric view of the set kicker.

The set transport 132 is utilized to unload automatically sets or stacks of copy sheets from the bins at an unload station two copy-cycle pitches or bins below the sorter bin load station at 93. As shown in FIG. 5, the set transport includes an elongated channel member 141 secured to the frame of the finishing apparatus and a clamp carriage 142 reciprocably slidable on a rod 143 secured at its ends to the underside of the member 141. The clamp carriage supports upper and lower moving jaws 144, 144*a*, respectively, which are adapted to grip an edge of a set or stack and convey the same from the bin array to the stapler apparatus 134 for a stapling operation, if that has been pre-programmed, or directly to the elevator 138 if programmed for the non-stapled mode. A cycle time period equal to the production of two copy sheets or the collection of a copy sheet in each of two successive bins is provided. During the period, the clamp carriage 142 is actuated for every other bin during each pass of the bin array in that during full upper movement of the array, six of the twelve bins are unloaded and the remaining bins are unloaded in the full downward movement.

The set transport also includes a reversible servo motor M-3 secured to one end of the member 141 and having a drive system connected by a timing belt 145 to a pulley 146 mounted for rotation at the other end of the member 141. The carriage 142 is fastened to the lower run of the belt 145 and energization of the servo motor M-3 effects reciprocable movement of the clamp carriage 142 to move the jaws 144, 144*a* to the sorter to a set gripping position, in the opposite direction to a set stapling position, and still further in that direction, to retract the jaws, all in cyclic actuation. In moving toward the sorter 102, the jaws 143, 144 are sensed by a sensor SR-2 mounted on the frame for the sorter to zero reference the positioning of the set transport as a timing monitor of subsequent timed events in the finishing function. The clamping and unclamping action of the jaws 144, 144*a* is provided by a solenoid valve in a pneumatic device 147 which is operatively connected to the jaws through a suitable travelling hose, not shown.

The kicker mechanism 136 is utilized to push or kick stapled sets from the stapler apparatus and permit dropping of the set onto the elevator 138. If a stacks mode or unstapled sets mode has been programmed, the kicker mechanism is arranged to serve as a backstop for the clamping jaws 144, 144*a* to strip stacks against. The kicker mechanism is mounted below the clamp carriage 142 and includes two upwardly extending kicker elements 148, one on each side of the clamping jaws 144, 144*a* in order to balance the kicker forces on a stapled set. The elements 148 are mounted for sliding movement produced by a crank comprising a set of two interconnected links 149, 150 arranged for cranking action by the rotation of a driven pulley 152. Drive is imparted to this pulley by way of a timing belt 153 and drive pulley 154 driven by a motor M-4 which is the motor utilized to drive the stapler heads as will be described hereinafter. Preferably, this motor is continuously energized for driving other components of the finishing apparatus 130 and the pulley 154 is selectively, drivingly connected to the motor as by a suitable electromagnetic clutch (not shown) in accordance with programmed arrangements.

If the finishing station has been programmed for unstapled sets or stacks, the electromagnetic clutch (not shown) for the set kicker will be energized to bring the arms 148 to a stationary position forward of its fully retracted position. As the set transport brings a set or stack to a position adjacent the arms 148, the jaws 144, 144*a* on the set transport will be programmed to open so that with continuing retraction of the set transport, the set or stack will be stripped from the jaws by the stationary kicker arms and allowed to settle on the elevator.

Figure 7:
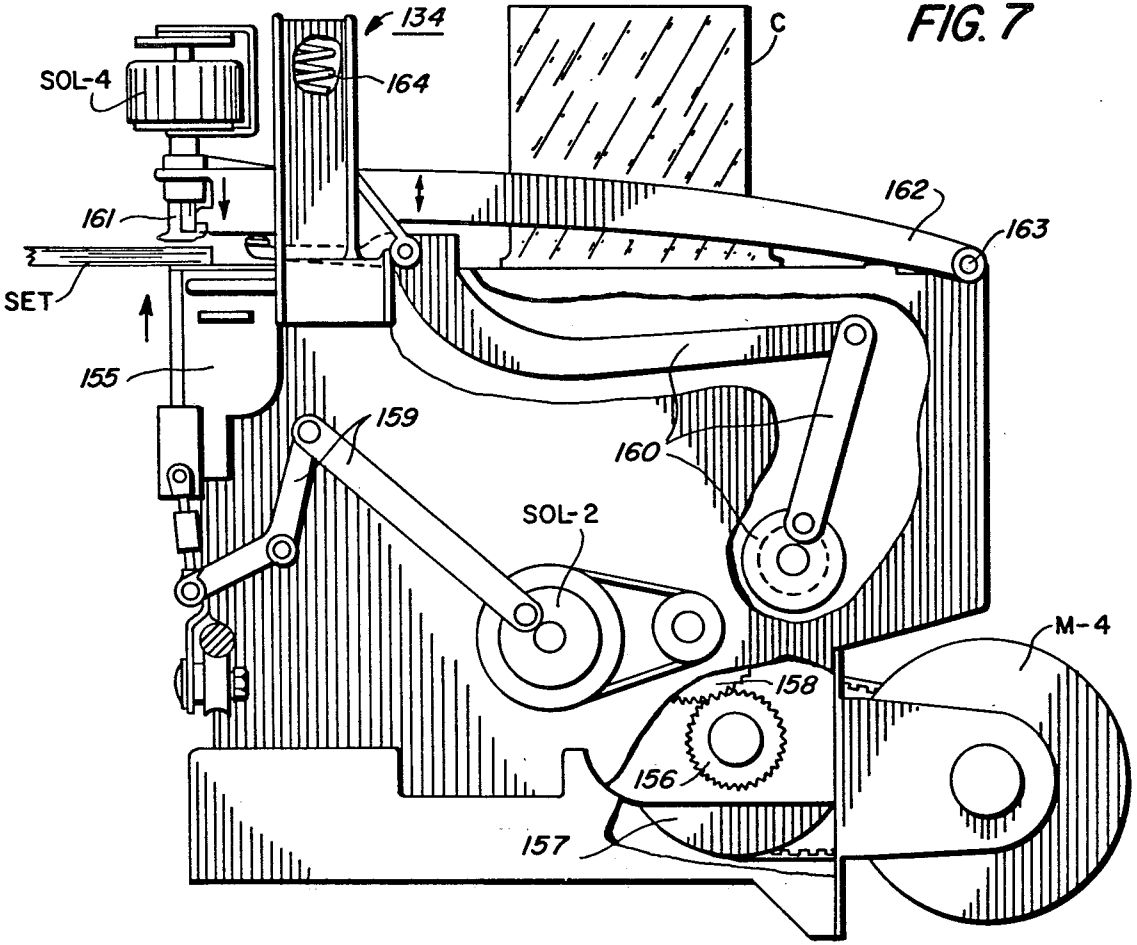
FIG. 7 is a partial isometric view of the stapling apparatus utilized in the finishing station.

The stapler apparatus 134 as shown in FIG. 7 provides a stapling function either with a single staple or with two staples, both being adapted to be applied at various positions along a long edge of a set or stack of copy sheets. Stapling is achieved by way of two identical mechanisms, each of which provides the function of set clamping, staple driving, and staple clinching. Preferably, the apparatus utilizes two commercial type stapler heads 155, such as the Bostitch staple head indicated as the 64-E manufactured by the Bostitch Division of Textron Corporation of Providence, R.I. Since the stapler mechanisms, drives therefor, and related structure are identical, only one will be described in detail in reference to FIG. 7.

Each of the heads 155 is mounted in an inverted position and is driven from a crank mechanism though the motor M-4. The mechanism includes an elongated, splined drive shaft 156 which is driven by the motor M-4 by means of a pulley 157 and timing belt, the drive shaft effecting clamping sets or stacks of sheets and actuation of the heads for driving staples thereinto. The driving connection between each of the heads 155, relative to the shaft 156, includes a gear 158 in continuous driving engagement with a splined section on the shaft so that each head may be moved toward and away from each other, or in the same direction, thereby permitting desired positioning of staples on the edges of sets or stacks. The gear 158 in turn actuates a crank mechanism 159 for imparting reciprocatory movement to the staple driver element of the respective head 155, thus causing separation of a staple from a stack of staples and driving of the staple legs through an edge of a set or stack. An electromagnetic clutch SOL-2 may be utilized with the crank mechanism in order to permit selective timed staple driving.

Clamping of the edges of sets or stacks prior to staple driving is also derived from the motor M-4 by a crank mechanism 160 driven in a manner similar to the head drive. The clamping mechanism includes an anvil 161 mounted on a long set of drive imparting arms 162 pivotally mounted at 163 on the frame structure for the stapling apparatus. The crank mechanism 160 drivingly connected to the shaft 156 by way of a suitable electromagnetic clutch SOL-3 compresses a relatively heavy clamp spring 164 during a drive connection. At the timed proper instant, the drive connection to the arms 162 is released and the spring 164 allowed to expand to bias the anvil 161 against the respective head 155, thereby effecting a clamping action relative to the edge of a set or stack to be stapled, as shown in FIG. 7. Finally, clinching action is provided by a solenoid SOL-4 mounted on the end of the set of arms 162. When energized, the solenoid produces bending of the legs of a staple and final binding of a set of copy sheets. Mounted above each of the heads 155 is a cartridge C containing a supply of sticks of staples for each of the heads. A feed device (not shown) may be utilized to automatically feed sticks to the supply end of the heads when needed.

A sensor SR-3 is positioned adjacent and between the heads 155 (see FIG. 1) and is utilized in conjunction with the sensor SR-2 to monitor the time between the zero reference of the jaws 144, 144*a* as they move toward a sorter bin and the time an edge of a set of copy sheets reaches the stapler heads to be stapled. This timing data is transmitted to the microprocessor in the programmer P.

These servo controllers provide complex motion control for relatively heavy apparatus which are actuated from a stopped position, accelerated to high speed activation, and then brought to a stop position, all at a continuous high rate of cyclic action. Therefore, accurate velocity profile control is necessary for each servo and constant position monitoring utilizing the switch S-1 and the sensors SR-1, SR-2 is provided.

The elevator 138 is utilized to collect into a pile the stapled or unstapled sets or stacks of copy sheets for delivery to the operator by way of the conveyor 140. As shown in FIGS. 1 and 3, the elevator comprises a tray assembly 165 mounted at the upper end of a vertically arranged, drive screw 166 threadedly received in a threaded member 167 vertically fixed to the base frame for the finisher base frame element 167 so that upon rotation of the member 167, the tray 165 is moved vertically in the up or down direction. A reversible motor M-5 is operatively connected to the member 167 for imparting rotation to the same in either direction. The tray has a plurality of conveyor belts 168 arranged for running on the surface thereof upon which stapled or unstapled sets or stacks are dropped when acted upon by the kicker mechanism 136. A motor M-6 is secured on and below the tray 165 and serves to drive the belts. Energization of this motor is two-fold so as to effect two distinct types of movement to the belts. In one type of movement, the belts are driven a short distance, say on the order of an inch (2.54 cm) or so in both directions, to provide set or stack offset. In another type of movement, the belts are driven to convey collected sets or stacks to the conveyor 140 for removal by the operator.

Elevator height of piled sets or stacks is controlled by an optical sensor SR-4 which "looks" across the stack and effects the energization of the motor M-5 and lowering of the tray 165 until the pile is below the sensor. A second sensor SR-5 is positioned to sense the lowermost position of the elevator tray 165 whereat the tray is considered at full capacity. The sensor SR-5 is arranged to effect the second type of movement of the belts 168 to convey a pile thereon to the conveyor 140 for removal. After this conveyance, the elevator is again returned to its uppermost position to receive additional sets or stacks and to become under the control of the sensor SR-4.

The conveyor 140 serves to receive a pile of stapled or unstapled sets or stacks from the elevator, to convey the pile out of the finishing station, and to hold it for operator removal. As shown in FIG. 3, the conveyor includes a support frame structure 170 having a plurality of conveyor belts 171 mounted thereon and a motor M-7 for driving the belts in a direction to pick up a pile of sets or stacks from the elevator 138 and to bring the same out of the space immediately between the stapler apparatus. A switch S-2 is mounted at the outer end of the structure 170 and includes an actuating element 172 arranged to protrude between the belts 171 so as to sense the presence of a pile on the belts.

In the event a pile is conveyed to the end of the belt, it will engage the actuator 172 to open the circuit to the motor M-7 and inhibit its energization. The switch S-2 is also electrically connected to the system logic and controller P and arranged so that upon its actuation, the elevator/offset motor M-6 will not be energized to convey another pile of sets or stacks onto the conveyor, and will assist in initiating the reverting of the machine to its standby position when the sensor SR-5 has sensed the lowermost position of the elevator tray 165. A suitable status indicator may be provided on the console for the machine to inform the operator of the machine status and why operation has ceased.

The machine will continue to operate to produce copy sheets and to maintain the bin array 104 in operation to complete its collation of an already started third cycle of exposures of the set of document sheets in the document handling apparatus 12. At the completion of document sheets exposures for that third set, the apparatus 12 will revert to its standby condition. When the processor 11 completes the production of the copy sheets for that set, it too will revert to its standby condition while the bin array 104 continues in operation to collate the remaining copy sheets. When completed, the collated copy sets remain in the bin array as no copy sets will be unloaded, and the entire system will assume the standby condition.

Reverting to standby is initiated when the finishing station has produced two full piles of sets or stacks one on the conveyor and one still on the elevator and the bin array has collected all of the copy sheets produced for one cycle of operation of the apparatus 12. In this manner, during the occasions when the storage capacity of the system has been attained and there are more copy sheets to be made, before the system achieves its standby condition, all processing apparatus and transports have been cleared of document sheets and copy sheets. In the foregoing descriptions, it was assumed the conveyor was adapted to hold only a single pile of sets or stacks. If the conveyor is capable of holding more than one pile, the additional number of piles must be added to the number of copy cycles considered above.

Reverting to standby may occur before a production is completed and in this event, the pre-set count and the running account of the run up to the point of reverting to standby will remain. Upon removal of the finished piles, the machine will automatically become operative to complete the programmed run.

Figure 8:
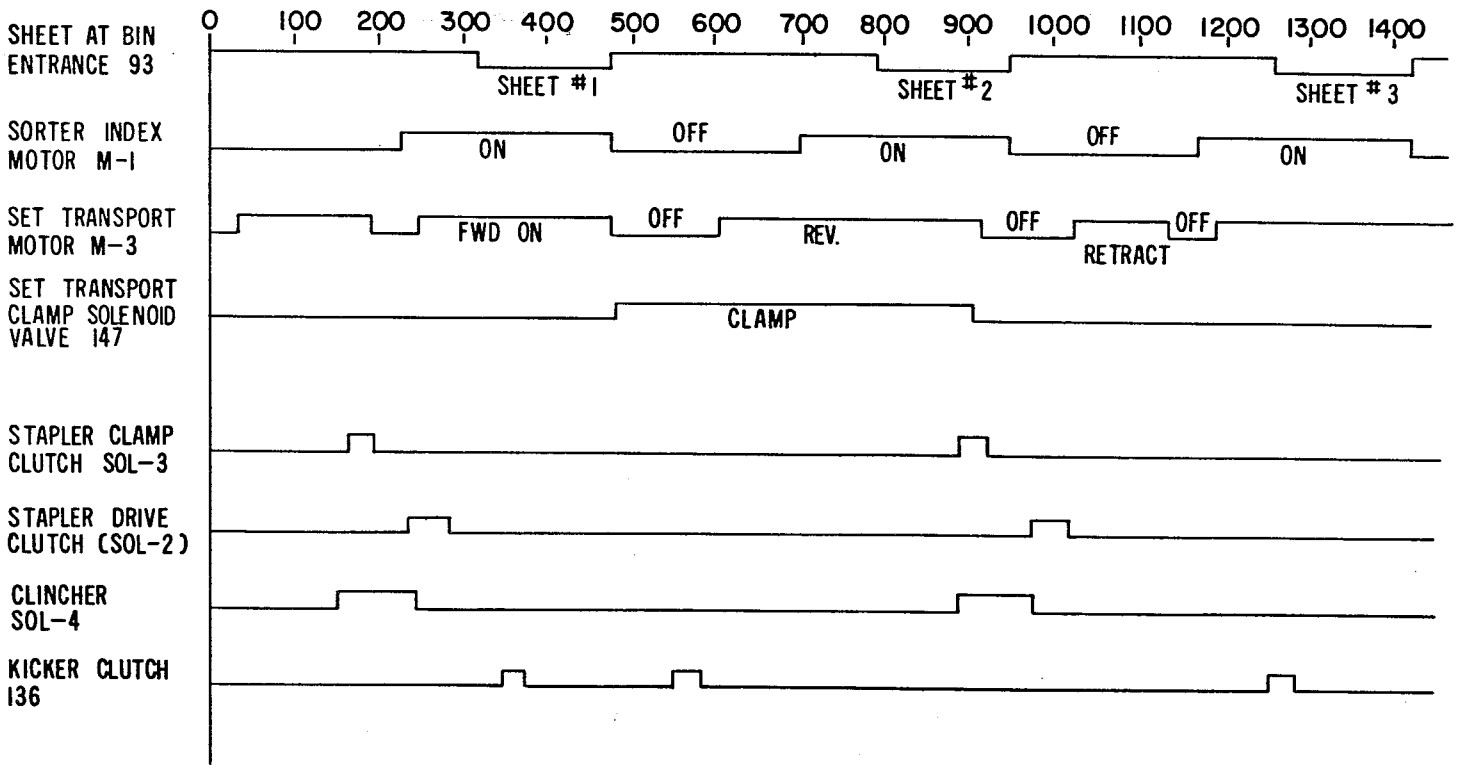
FIG. 8 is a timing diagram for the various timed events occurring during a reproduction/finishing run.
Figure 9A:
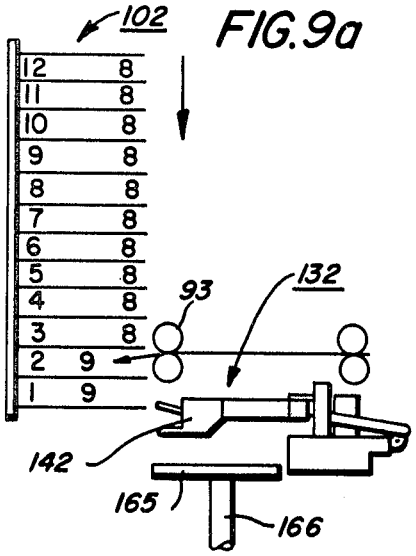
Figure 9B:
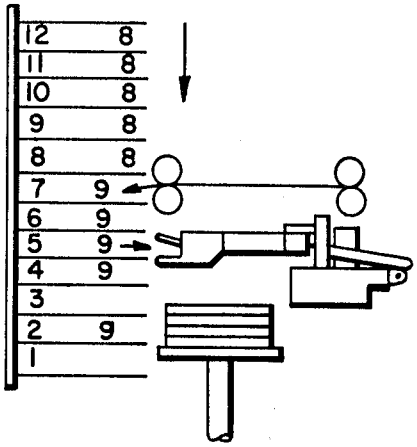
Figure 9C:
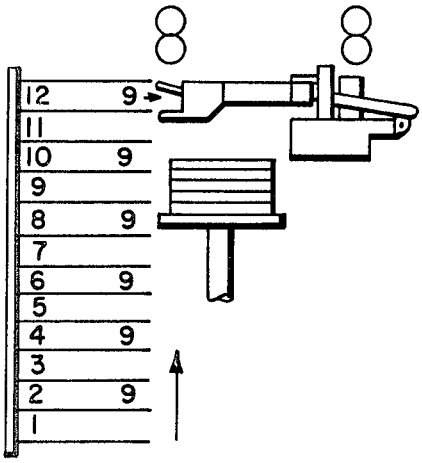
Figure 9D:
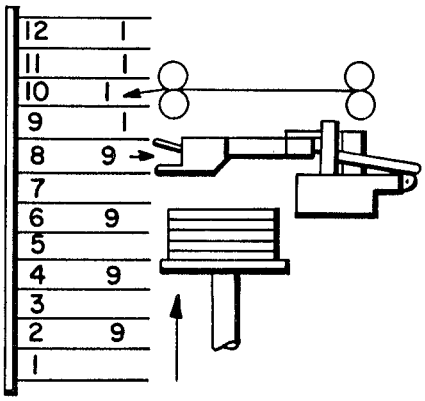
Figure 10A:
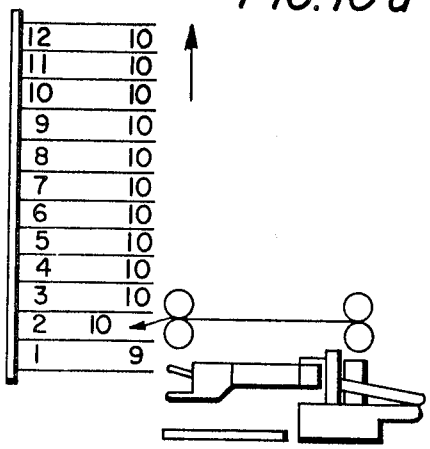
Figure 10B:
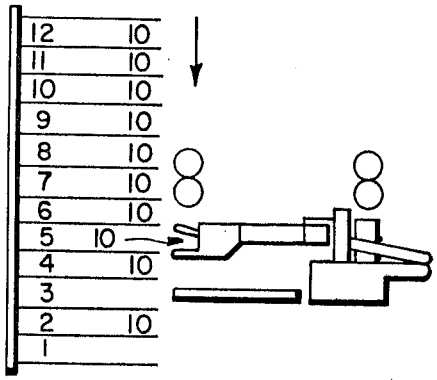
Figure 10C:
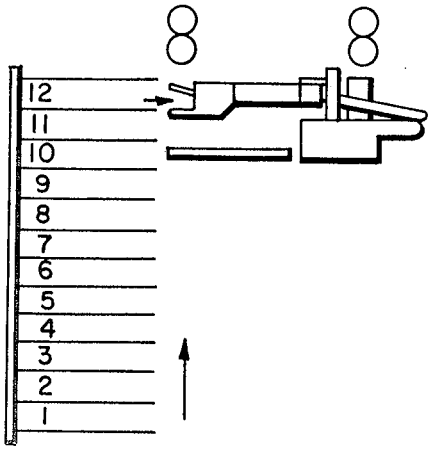
Figure 10D:
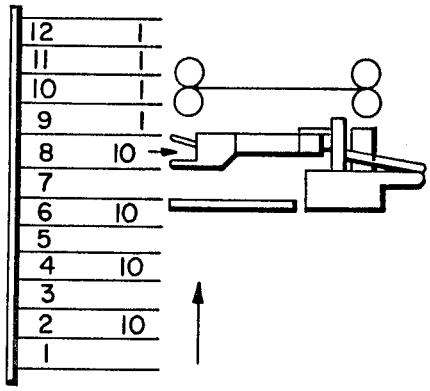

The timing chart in FIG. 8 illustrates a typical sequence of timed events occurring in the finishing apparatus 102. For this illustration, it is assumed that the machine has been programmed for the sets mode of operation for the production and stapling of sets of post-collated copy sheets. For simplicity, only three copy sheets are acted upon as noted in the uppermost curve of the chart. The timing periods along the abscissa of the chart are in milliseconds and are in accordance with a copy sheet production rate in the processor 11 of 120 copies per minute or one copy sheet every 0.5 seconds.

In the illustrated chart, the first sheet in the top curve has its leading edge at the reference point 93 adjacent the entrance to a bin at a point in time over 300 milliseconds after zero time reference. Just prior to this time, the following events would have taken place: the scuffer motor M-2 would have been energized and stays in that condition throughout the sorting and finishing operation; the motor M-1 would have energized to commence indexing a bin adjacent the reference 93 in a position to receive the first of the illustrated sheets; and the motor M-3 would have been activated to commence activation of the set transport to move the carriage 142 and jaws 144, 144*a* toward the second bin below the bin awaiting the first sheet (assuming that stapling is to occur). Before the trailing edge of the first sheet passes the reference point 93, the motor M-1 is deenergized, while the jaws 144, 144*a* for the set transport continue to move within the bin affected thereby. The solenoid valve device 147 for the set transport is activated to effect clamping of the jaws on the near edge of a set just after the index motor M-3 is deenergized and before the motor M-3 is reenergized to return the carriage 142 to the stapler position. While the device 147 is still activated to maintain clamping of the set, the carriage is moved to a position for the application of one or two staples along the clamped edge of the set.

While in the stapling position, the copy sheets set edge experiences the three operative steps of stapling: clamping, driving of a staple, and clinching. The three curves in FIG. 8 relating to stapling are shown in their proper timed relationship. While the relative timing shown in the curves of FIG. 8 has been experienced in actual practice, it will be understood that timing parameters are merely illustrative and that other timing values may be utilized for matching optimum conditions to circumstances derived from actual structure. For example, it is noted that the energization of the clincher clutch SOL-4 occurs before the clamping clutch SOL-3 is energized when in fact, clamping action must precede clinching. This apparent disparity can be made understandable when it is considered that some active clinching devices require slow-reacting mechanical elements in fulfilling its function. Therefore, while clutch SOL-4 may be energized sooner than the clutch SOL-3, its function will be attained later. After stapling is accomplished and the jaws 144, 144*a* are released, the kicker mechanism 136 is operated to remove the clamped edge out of the jaws and permit dropping of the stapled set onto the elevator 138. It will be noted that the events pertaining to stapling, that is, set transport motion, set transport clamping, the stapling steps and the kicker mechanism actuation all occur once for every two sheet movements to the reference point 93.

In FIGS. 9(*a*)–(*d*) and 10(*a*)–(*d*), there is shown sequences of sorting and finishing events for a document having an odd number of document sheets and an even number of document sheets, respectively. In these illustrations, the vertical column of numbers 1–12 at the left of each sequence indicate the bin number and the right hand vertical column of numbers indicate the copy of the document sheet being collected. As previously stated, it is assumed that the document handling apparatus 12 is programmed to place a document sheet upon the platen 14 and to effect twelve exposures of the sheet before the removal of the document sheet and placement of a succeeding document sheet, and so on. This assumption also corresponds with the number of bins in the array 102 wherein each copy sheet produced during the exposure of a document sheet on twelve occurrences is received in a bin.

In FIG. 9(*a*), each of the bins 3–12 contain eight copy sheets while bins 1 and 2 contain all nine sheets. The bin array 102 is indexing from its upper to lower positions and in so doing, will receive the ninth copy sheet of a document sheet in the bins numbered 3–12. In this example, it will be assumed that there are nine document sheets in the document being processed in the document handling apparatus 12. Since the ninth copy sheet is the last sheet in the sets being produced, as the array 102 indexes downwardly, as shown in FIG. 9(*b*) to receive each last sheet, the sets, now complete, in the odd numbered bins will be acted upon by the finishing function comprising the set transport mechanism, the stapler apparatus and the set kicker mechanism, as aforesaid. It will be noted that in the finishing function, every other bin is affected during the downward movement of the array, while every successive bin receives the ninth copy sheet. Since the convention in the described example is such that a copy sheet is produced every one-half second, registered and clamped sets are delivered to the stapler at one second intervals.

In FIG. 9(*c*), on the upwardly return indexing movement of the array, the remaining sets in the even numbered bins are removed and finished. In the event more than twelve copies of the nine-sheet document has been programmed, the upwardly indexing array, in going from its position in FIG. 9(*c*) to the positioning in FIG. 9(*d*) will receive the first copy sheets for the first document sheet being processed in the apparatus 12 as the latter commences its recycling sequences. This process continues, with the document being copied in multiples of twelve sets until the copying/finishing run has been completed or terminated.

In FIGS. 10(*a*)–(*d*), the sequences are repeated for a document which consists of an even number of document sheets. In this example, (the tenth copy sheet is the last sheet in a set), the array 102 is indexing upwardly from its down position to receive the last sheet in each set (see FIG. 10(*a*)). In FIG. 10(*b*), as the array indexes downwardly, every other bin (odd numbered bins) is unloaded and stapled and in FIG. 10(*c*), the even numbered bins are unloaded during the upward indexing of the array. Another series of copy sheets begin to be received in the array during the final upward indexing which unloads the remaining sets in the previous document pass (see FIG. 10(*d*)).

FIG. 11 is a block diagram of a control arrangement for the reproduction system in FIG. 1. The programmer P is operatively connected to four remotes: (1) the processor 11 for controlling the xerographic processing, copy sheet movement, timing and monitoring and all other parameters in the processor; (2) the input station comprising the flash illumination system and circuitry and copy size reduction if this feature is available; (3) the automatic document handling apparatus 12; and (4) the finishing station 13.

The finishing station 13 includes two drivers, one of which is operatively connected by way of relays or reediac to the elevator motor M-5, the conveyor motor M-7, the scuffer motor M-2, and the offset producing motor M-6. The other driver is operatively connected to a servo controller which in turn is connected to two power amplifiers and associated circuitry. One of the power amplifiers serves to energize and operate the sorter array index motor M-1, while the other amplifier serves to energize and operate the set transport motor M-3. As previously stated, these motors impress rather complex movements on various structures and there is a need to maintain accurate velocity profile controls. One of the power amplifiers also is operatively connected to the stapler drive clutch SOL-2, the clamping clutches SOL-3, the clinching clutches SOL-4, and the solenoid valve device 147.

When the system has been programmed for a stacks mode of operation, that is, each bin of the array 102 will only receive copies of a particular document sheet either by way of the document handling apparatus 12 or by manual placing on the platen 14, the operation of the system is varied somewhat. The document apparatus 12 will operate to bring each document sheet upon the platen 14 and to expose the same the number of times for which the programmer P has been manipulated by the operator for number of copies. Assuming the system was programmed for 80 copies of the set of document sheets in the apparatus 12, 80 copies of the first sheet in the document set will be reproduced and delivered to one of the bins in the array 102. The apparatus 12 will remove the first document sheet from the platen and feed the second document sheet thereon and commence exposing the same the same number of times, and so on for each document sheet until the set is completed.

The 80 copy sheets for the first document sheet will be delivered to the first bin whereupon the array 102 will be indexed one bin thereby presenting the second bin at the receiving point 93 for receiving the 80 copies of the second document sheet, and so on. The sequencing of the movement of the array 102 and the set transport 132 will be the same as during the sets mode of operation as exemplified in FIGS. **9*b* and 9*d*. In the downward and upward movement of the array, the set transport will unload the stacks in every other bin. However, since no stapling action will generally be programmed, the set kicker 136 will be positioned so that the jaws for the set transport will release a stack to permit its dropping onto the elevator 138 and to effect repeated energization of the motor M-6** to position alternately each dropped stack in offset relationship.

The elevator 138 cooperates with the conveyor 140 in the same manner as when programmed for the sets mode of operation. In this manner, the system is arranged to permit "Limitless" stack collection as well as "limitless" copy set collection.

In the flow diagram of FIG. 12, the two finishing modes of operation, that, is, sets mode and stacks mode, are both shown in relation to various fixed and optional sub-modes of operation. In the sets mode wherein copy sheets are post-collated, the programmer P typically utilizes the number 60 to decide whether the stapling action is available. If the number of copy sheets to be collected in each bin and stapled is greater than 60, there is no stapling action permitted since the number of sheets is too great for the machine capability. If the number of copy sheets is greater than 60, and also greater than 100, the set transport will also be inhibited and only manual unload from the bin array 102 will be possible since the set transport will be unable to hold over 100 copy sheets. If the number of copy sheets is less than 100 and greater than 60, an operator has the option of manual unload from the bin array which option is always available, or of automatic offset upon the elevator 138. If the number of copy sheets is less than 60, the operator may select manual unload, stapling or automatic offset.

If the stacks mode of operation is selected, and the number of sheets to be stacked in each of the bins is greater than 100, as in the sets mode, only manual unload is available. If more than 60 and less than 100 copy sheets are involved per bin, only manual unload and automatic offset is available. If less than 60 copy sheets are to be handled per bin, the operator has the additional option of stapling if such manner of finishing is desired. While the numbers 60 and 80 were utilized in the foregoing description for determining certain events in the system operation, it will be understood that any other suitable numbers may be chosen. Counting to arrive at these numbers for system control may be provided in the automatic document handling apparatus 12 by counting each document sheet during the first complete sequencing of the set of document sheets. This type of counting is well known in some commercial copiers for various functions.

It will be seen that the system described in the foregoing provides among other things automatic offsetting of unstapled copy sets and stacks. Thus, an operator may wish to produce very large numbers of stacks and to have these piled in offset relationship. In conventional reproduction systems, to produce large numbers of stacks, an operator has to employ a large sorting apparatus for producing stacks, one stack to each bin of the sorting apparatus. These stacks must then be removed manually and piled in offset relationship on suitable output conveying devices. In the present system, this operation is accomplished automatically and in a "limitless" manner as aforesaid.

From the foregoing it will be apparent that an electrostatogrpahic system with finishing station has been described which will permit the high volume production without the need for utilizing extra-volume copy sets/stacks collecting mechanisms or storage containers. The present invention in effect provides "limitless" copy set or stack collection by reverting the system to a standby condition and holding the production count when the system's full capacity to hold unremoved copy sets or stacks has been reached.

While the invention has been described with reference to the structure disclosed, it is not confined to the details set forth but is intended to cover such modifications or changes as may come within the scope of the following claims.

We claim:

1. In a reproduction system for producing copies from a set of document sheets of a multi-page document including an image processor for producing copy sheets and a finishing apparatus whereat copy sheets of the document are collected, the improvement comprising:

program means for presetting the number of copies of the document to be made by the processor during a reproduction run, and to condition the system to produce the copies in a stack mode of operation, copy sheet collecting means arranged to collect copy sheets in a plurality of stacks, wherein a predetermined number of copies of a particular document sheet is produced before a succeeding document sheet is reproduced, transport means for moving each stack from said collecting means and to deposit the stacks in a vertically arranged pile upon a receiving member, and means for reciprocably moving said member as each stack is deposited thereon for effecting the offsetting of the stacks during piling thereof.

2. In a reproduction system for producing and collating copies from a set of document sheets of a multi-page document including an image processor for producing copy sheets and a finishing apparatus whereat copy sets of the document are collected and bound, the improvement comprising:

program means for presetting the number of copy sets of the document to be made by the processor during a reproduction run, a first copy set receiving means arranged to collect copy sets after binding thereof until a plurality of copy sets of a predetermined number has been collected, means for moving the copy sets from said first receiving means to a second receiving copy set means when said predetermined number has been attained to permit said first receiving means to collect additional copy sets, and control means responsive to said program means when preset for a number of copy sets greater than at said first and said second receiving means when said first receiving means has attained said predetermined number and said second receiving means has copy sets thereon to limit the number of copy sets made by the processor to no more than those copy sets already on said first and said second receiving means before further copy sets are made to permit continuing to completion of said reproduction run.

3. In a reproduction system for producing and collating copies from a set of document sheets of a multi-page document including an image processor forproducing copy sheets and a finishing apparatus whereat copy sets of the document are collected and bound, the improvement comprising:

program means for presetting the number of copy sets of the document to be made by the processor during a reproduction run, copy set receiving means arranged to collect copy sets, after binding thereof one upon the other to form a pile until a predetermined height of the pile has been reached, transport means for moving a pile of copy sets from said receiving means to a removal station when a pile has reached said predetermined height to permit said receiving means to collect additional copy sets, and control means response to said program means when preset for a number of copy sets greater than the number of copy sets at said removal station and said receiving means when a pile has reached said predetermined height to limit the number of copy sets made by the processor to no more than those copy sets already on said receiving means and said removal station before further copy sets in accordance with said preset program are made to permit continuing to completion of said reproduction run.

4. In a reproduction system for producing copies from a set of document sheets of a multi-page document including an image processor for producing copy sheets and a finishing apparatus whereat copy sheets of the document are collected, the improvement comprising, program means for presetting the number of copies of the document to be made by the processor during a reproduction run and to condition the system for producing selectively the copies in bound copy sets, unbound copy sets or stacking, a copy set receiving means arranged to collect the copies in a pile either as a plurality of bound copy sets, unbound copy sets or in stacks, until a plurality of copy sets of a predetermined number has been collected, and control means responsive to said program means and cooperable with said copy set receiving means for arranging said copies in said pile in offset relationship while the apparatus is producing only unbound copy sets or stacks.

* * * * *